US007183838B2

(12) United States Patent
Iwase

(10) Patent No.: US 7,183,838 B2
(45) Date of Patent: Feb. 27, 2007

(54) SEMICONDUCTOR DEVICE HAVING INTERNAL POWER SUPPLY VOLTAGE DROPPING CIRCUIT

(75) Inventor: Taira Iwase, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 77 days.

(21) Appl. No.: 11/029,369

(22) Filed: Jan. 6, 2005

(65) Prior Publication Data

US 2005/0179485 A1 Aug. 18, 2005

(30) Foreign Application Priority Data

Jan. 15, 2004 (JP) ..... 2004-008305

(51) Int. Cl.
*G05F 1/10* (2006.01)
*G05F 3/02* (2006.01)

(52) U.S. Cl. ..... 327/541; 327/543; 323/313

(58) Field of Classification Search ..... 327/538, 327/539, 541, 543; 323/313
See application file for complete search history.

(56) References Cited

U.S. PATENT DOCUMENTS 5,352,935 A * 10/1994 Yamamura et al. ..... 327/540
5,361,000 A 11/1994 Koshikawa et al. ..... 327/530
5,493,234 A * 2/1996 Oh ..... 326/33
6,184,744 B1 * 2/2001 Morishita ..... 327/541
6,259,240 B1 * 7/2001 Smith ..... 323/313
6,313,694 B1 * 11/2001 Sohn ..... 327/541
6,563,371 B2 * 5/2003 Buckley et al. ..... 327/539
6,570,436 B1 * 5/2003 Kronmueller et al. ..... 327/538
6,661,279 B2 * 12/2003 Yabe ..... 327/546

FOREIGN PATENT DOCUMENTS

JP 5-159572 6/1993

* cited by examiner

*Primary Examiner*—Timothy P. Callahan
*Assistant Examiner*—William Hernandez
(74) *Attorney, Agent, or Firm*—Oblon, Spivak, McClelland, Maier & Neustadt, P.C.

(57) ABSTRACT

A semiconductor device includes a reference voltage generation circuit, an amplifier circuit, and a voltage dropping circuit. The reference voltage generation circuit includes a negative feedback circuit to generate a reference voltage controlled by an output signal from the negative feedback circuit. The amplifier circuit amplifies the output signal from the negative feedback circuit at the leading edge of an external power supply voltage or the input time of an external signal. The voltage dropping circuit drops the external power supply voltage in accordance with the reference voltage output from the reference voltage generation circuit to generate an internal power supply voltage.

13 Claims, 5 Drawing Sheets

SEMICONDUCTOR DEVICE HAVING INTERNAL POWER SUPPLY VOLTAGE DROPPING CIRCUIT

CROSS-REFERENCE TO RELATED APPLICATIONS

This application is based upon and claims the benefit of priority from prior Japanese Patent Application No. 2004-008305, filed Jan. 15, 2004, the entire contents of which are incorporated herein by reference.

BACKGROUND OF THE INVENTION

1. Field of the Invention

The present invention relates to a semiconductor device and, more particularly, to a semiconductor device having an internal power supply voltage dropping circuit.

2. Description of the Related Art

In recent years, as the microfabrication of a MOS transistors (MOS field-effect transistors) has progressed, gate oxide film thickness must be reduced in accordance with the scaling rule. Thus, since the electric field applied to the gate oxide film must be relaxed, an internal power supply voltage dropping circuit (to be referred to as a voltage dropping circuit hereinafter) is used in order to set the power supply voltage used in a chip lower than the external power supply voltage (see, e.g., Jpn. Pat. Appln. KOKAI Publication No. 5-159572 (FIG. 2 and the like)).

The operating principle of the voltage dropping circuit will be described below. The internal power supply voltage dropped by a power supply current supply transistor is monitored, and the monitored internal power supply voltage is compared with a reference voltage generated by a reference voltage generation circuit (to be referred to as a reference voltage circuit) inside the chip. In accordance with the comparison result, the power supply current supply transistor is negatively fed back to maintain the constant internal power supply voltage.

However, a negative feedback circuit must respond at a certain speed or more, and steadily pass a current at a certain magnitude or more. Hence, it is difficult to design a product whose current consumption must be low, thus posing a problem. Even in the above-described voltage dropping circuit, the response of a feedback loop deteriorates when reducing the current flowing into a negative feedback circuit. Therefore, the internal power supply voltage readily fluctuates, or oscillates in the worst case. More specifically, since the circuit operates differently from normal operation at the leading edge of the external power supply voltage, the circuit operates unstably. For this reason, the internal power supply voltage easily oscillates. Once the internal power supply voltage oscillates, the oscillation leads to continuous oscillation and an operation error, thus posing a problem.

BRIEF SUMMARY OF THE INVENTION

According to an aspect of the present invention, a semiconductor device comprises: a reference voltage generation circuit which includes a negative feedback circuit, and generates a reference voltage controlled by an output signal from the negative feedback circuit; an amplifier circuit which amplifies the output signal from the negative feedback circuit at at least one of a leading edge of an external power supply voltage and input time of an external signal; and a voltage dropping circuit which drops the external power supply voltage in accordance with the reference voltage output from the reference voltage generation circuit to generate an internal power supply voltage.

According to another aspect of the present invention, a semiconductor device comprises: a reference voltage generation circuit which generates a reference voltage; a voltage dropping circuit which includes a negative feedback circuit for outputting an output signal in accordance with the reference voltage output from the reference voltage generation circuit, and a divided voltage of an internal power supply voltage obtained by dropping an external power supply voltage, and generates the internal power supply voltage controlled by the output signal from the negative feedback circuit; and an amplifier circuit which amplifies the output signal from the negative feedback circuit at at least one of a leading edge of an external power supply voltage and input time of an external signal.

According to still another aspect of the present invention, a semiconductor device comprises: a reference voltage generation circuit which includes a first negative feedback circuit, and generates a reference voltage controlled by an output signal from the first negative feedback circuit; a first amplifier circuit which amplifies the output signal from the first negative feedback circuit at at least one of a leading edge of an external power supply voltage and input time of an external signal; a voltage dropping circuit which includes a second negative feedback circuit for outputting an output signal in accordance with the reference voltage output from the reference voltage generation circuit, and a divided voltage of an internal power supply voltage obtained by dropping the external power supply voltage, and generates the internal power supply voltage controlled by the output signal from the second negative feedback circuit; and a second amplifier circuit which amplifies the output signal from the second negative feedback circuit at at least one of the leading edge of the external power supply voltage and the input time of the external signal.

DETAILED DESCRIPTION OF THE INVENTION

Figure 1:
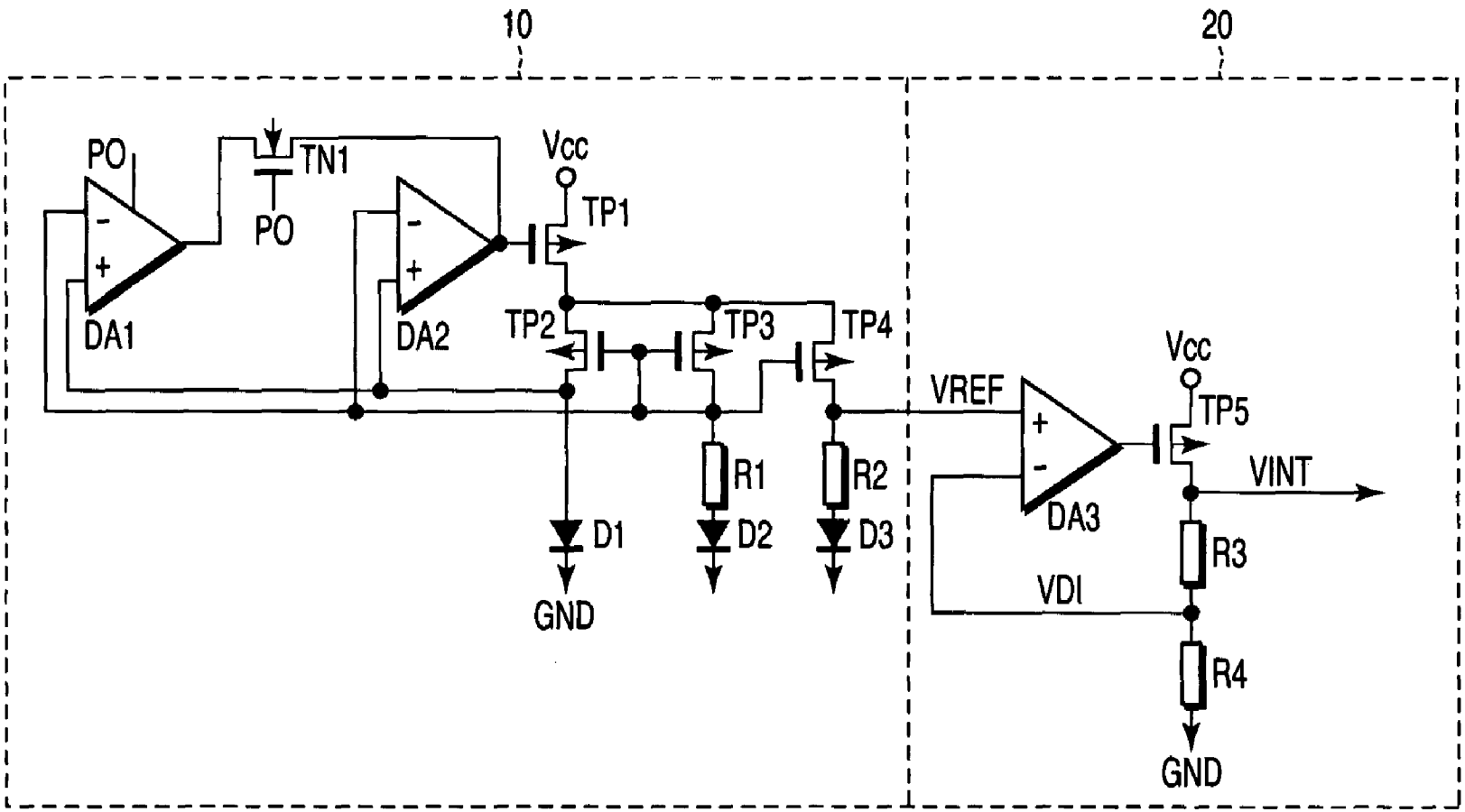
FIG. 1 is a circuit diagram showing the arrangement of a semiconductor device according to a first embodiment of the present invention.

Embodiments of the present invention will be described below with reference to the accompanying drawing. In this description, the same reference numerals denote the same parts throughout the drawing.

First Embodiment

First, a semiconductor device according to a first embodiment of the present invention will be described. This semiconductor device prevents a reference voltage circuit from unstable operation when turning on an external power supply.

FIG. 1 is a circuit diagram showing the arrangement of the semiconductor device according to the first embodiment. This semiconductor device includes a reference voltage circuit 10 and a voltage dropping circuit 20. The reference voltage circuit 10 includes two differential amplifiers DA1 and DA2, an n-channel MOS transistor (to be referred to as an nMOS transistor hereinafter) TN1, p-channel MOS transistors (to be referred as pMOS transistors hereinafter) TP1, TP2, . . . , TP4, diodes D1, D2, and D3, and resistors R1 and R2. An external power supply voltage Vcc is applied to the source of the pMOS transistor TP1, and the drain of the pMOS transistor TP1 is connected to the sources of the pMOS transistor TP2, TP3, and TP4. The drain of the pMOS transistor TP2 is connected to the anode of the diode D1, and the drain of the pMOS transistor TP3 is connected to the anode of the diode D2 via the resistor R1. Also, the drain of the pMOS transistor TP4 is connected to the anode of the diode D3 via the resistor R2.

The drain of the pMOS transistor TP2 is connected to the positive (+) input terminals of the differential amplifiers DA1 and DA2. Also, the drain of the pMOS transistor TP3 is connected to the negative (−) input terminals of the differential amplifiers DA1 and DA2, and the gates of the pMOS transistors TP2, TP3, and TP4. The output terminal of the differential amplifier DA1 is connected to the output terminal of the differential amplifier DA2, and the gate of the pMOS transistor TP1 via the nMOS transistor TN1. Also, a power-on signal PO is supplied to the control terminal of the differential amplifier DA1, and the gate of the nMOS transistor TN1. Ground potential GND is applied to the cathodes of the diodes D1, D2, and D3. A reference voltage VREF is output from the drain of the pMOS transistor TP4 into the voltage dropping circuit 20.

The voltage dropping circuit 20 includes the differential amplifier DA3, pMOS transistor TP5, and resistors R3 and R4. The external power supply voltage Vcc is applied to the source of the pMOS transistor TP5, and the drain of this pMOS transistor TP5 is connected to the negative input terminal of the differential amplifier DA3, and one terminal of the resistor R4 via the resistor R3. The reference voltage VREF is applied from the reference voltage circuit 10 to the positive input terminal of the differential amplifier DA3, and the ground potential is applied to the other terminal of the resistor R4. An internal power supply voltage VINT is output from the drain of the pMOS transistor TP5.

Next, the operation of the semiconductor device shown in FIG. 1 will be described.

The differential amplifiers DA1 and DA2 perform negative feedback to an output from a current mirror circuit made from the diodes D1 and D2, resistor R1, and pMOS transistors TP2 and TP3 to maintain the constant reference voltage VREF within a voltage range even if the power supply voltage Vcc changes.

In the reference voltage circuit 10, the differential amplifiers DA1 and DA2 are connected in parallel with the output from the pMOS transistors TP2 and TP3 included in the current mirror circuit. The steady current of the differential amplifier DA1 is larger than that of the differential amplifier DA2 to increase driving capability. As a result, the response of the feedback loop improves.

Figure 2:
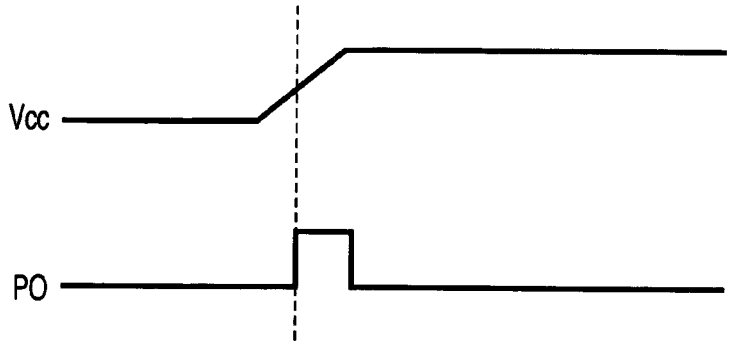
FIG. 2 is a timing chart showing the leading edge of an external power supply voltage Vcc, and a power-on signal according to the first, and second and third embodiments.

As shown in FIG. 2, at the leading edge of the external power supply voltage Vcc, e.g., at power-on, the leading edge of the power supply voltage Vcc is detected by using a known power-on detection circuit to output the power-on signal PO with a constant pulse width. This power-on signal PO is supplied to the control terminal of the differential amplifier DA1, and the gate of the nMOS transistor TN1 which are included in the negative feedback circuit. Hence, the differential amplifier DA1 operates only for a predetermined time to turn on the transistor TN1. Thus, the current flowing into the output terminal of the differential amplifier DA2 and the gate of the pMOS transistor TP1 increases to improve the response of the feedback loop. In this operation, the negative feedback circuit can be prevented from unstable operation at the leading edge of the external power supply voltage Vcc to maintain the constant reference voltage VREF.

In the voltage dropping circuit 20, the reference voltage VREF from the reference voltage circuit 10 is supplied to the positive input terminal of the differential amplifier DA3. The internal power supply voltage VINT is divided by the resistors R3 and R4 to generate a divided voltage VDI. The differential amplifier DA3 compares the divided voltage VDI with the reference voltage VREF, and this comparison result is amplified and supplied to the gate of the current supply transistor TP5. If the internal power supply voltage VINT is reduced, the divided voltage VDI is also reduced. Accordingly, the gate voltage of the pMOS transistor TP5, which is supplied from the differential amplifier DA3 is also reduced. Hence, the internal power supply voltage VINT is returned to a start voltage by supplying the current. As described above, the negative feedback is performed by using the divided voltage VDI of the internal power supply voltage VINT, the reference voltage VREF, the differential amplifier DA3, and the current supply transistor TP5 to maintain the constant internal power supply voltage VINT. Any type of differential amplifier is allowed in this operation. However, a current mirror differential amplifier is often used.

Note that when the general operating state is implemented at this leading edge of the external power supply voltage Vcc, the differential amplifier DA1 and the nMOS transistor TN1 are turned off. Hence, the steady current of the negative feedback circuit decreases to reduce current consumption in the general operating state.

As described above, in this embodiment, the steady current of the negative feedback circuit increases only when turning on the power supply to apply the stable internal power supply voltage even when turning on the power supply. In the general operating state, i.e., except power-on, the steady current of the negative feedback circuit can decrease to reduce current consumption.

Second Embodiment

Next, a semiconductor device according to a second embodiment of the present invention will be described. This semiconductor device prevents a voltage dropping circuit from an unstable operation when turning on an external power supply. The same reference numerals denote the same parts as in the first embodiment.

Figure 3:
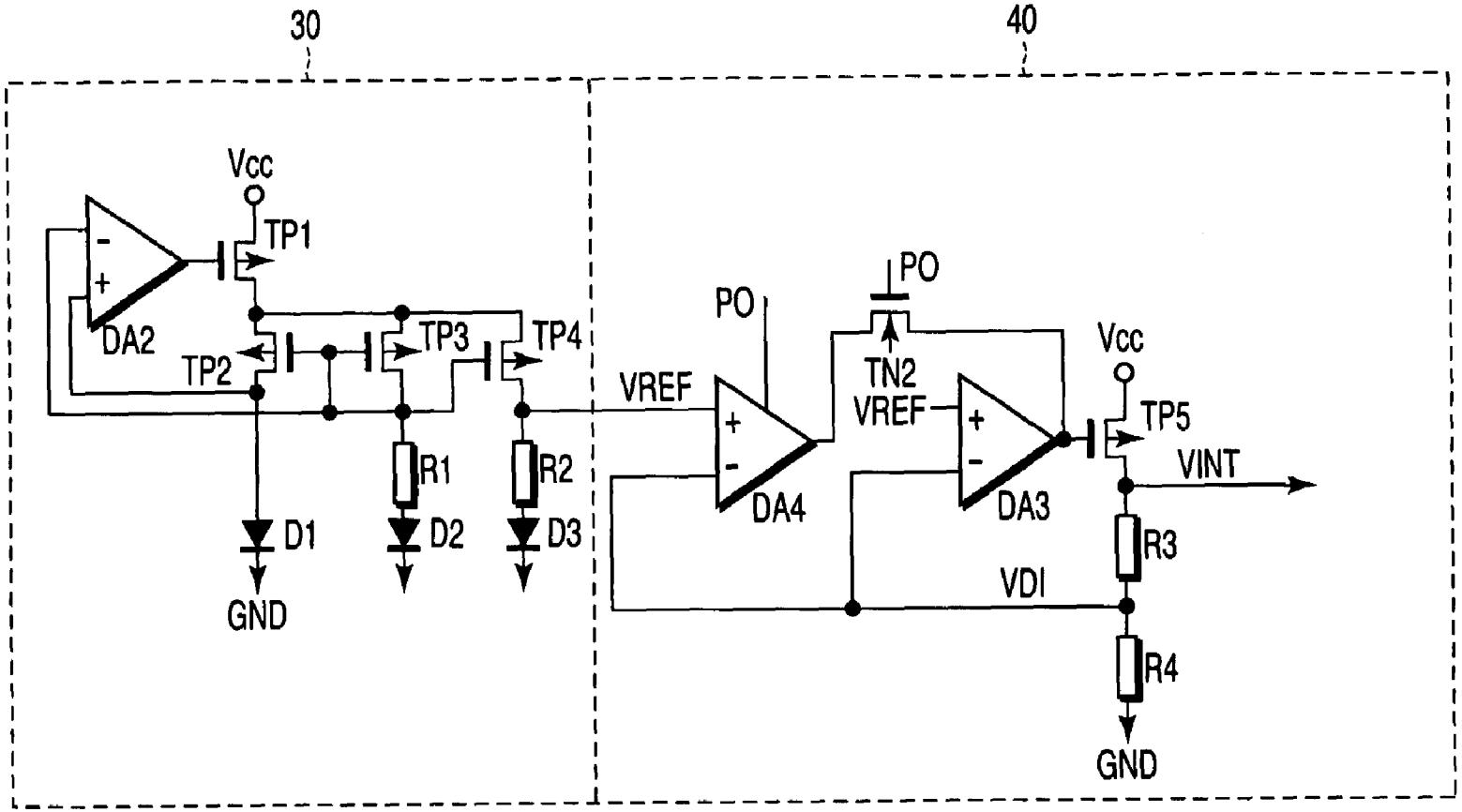
FIG. 3 is a circuit diagram showing the arrangement of a semiconductor device according to a second embodiment of the present invention.

FIG. 3 is a circuit diagram showing the arrangement of the semiconductor device according to the second embodiment. This semiconductor device includes a reference voltage circuit 30 and a voltage dropping circuit 40. The reference voltage circuit 30 includes a differential amplifier DA2, PMOS transistors TP1, TP2, . . . , TP4, diodes D1, D2, and D3, and resistors R1 and R2. An external power supply voltage Vcc is applied to the source of the PMOS transistor TP1, and the drain of the pMOS transistor TP1 is connected to the sources of the pMOS transistor TP2, TP3, and TP4. The drain of the pMOS transistor TP2 is connected to the anode of the diode D1, and the drain of the pMOS transistor TP3 is connected to the anode of the diode D2 via the resistor R1. Also, the drain of the pMOS transistor TP4 is connected to the anode of the diode D3 via the resistor R2.

The drain of the pMOS transistor TP2 is connected to the positive input terminal of the differential amplifier DA2. Also, the drain of the pMOS transistor TP3 is connected to the negative input terminal of the differential amplifier DA2, and the gates of the pMOS transistors TP2, TP3, and TP4. The output terminal of the differential amplifier DA2 is connected to the gate of the pMOS transistor TP1. Also, a ground potential GND is supplied to the cathodes of the diodes D1, D2, and D3. A reference voltage VREF is output from the drain of the pMOS transistor TP4 into the voltage dropping circuit 40.

The voltage dropping circuit 40 includes two differential amplifiers DA3 and DA4, an nMOS transistor TN2, a pMOS transistor TP5, and resistors R3 and R4. The external power supply voltage Vcc is applied to the source of the PMOS transistor TP5, and the drain of this pMOS transistor TP5 is connected to the negative input terminals of the differential amplifiers DA3 and DA4, and one terminal of the resistor R4 via the resistor R3. The reference voltage VREF is applied to the positive input terminals of the differential amplifiers DA3 and DA4, and the output terminal of the differential amplifier DA4 is connected to the output terminal of the differential amplifier DA3, and the gate of the pMOS transistor TP5 via the nMOS transistor TN2. Furthermore, a power-on signal PO is supplied to the control terminal of the differential amplifier DA4 and the gate of the nMOS transistor TN2, and the ground potential is applied to the other terminal of the resistor R4. An internal power supply voltage VINT is output from the drain of the pMOS transistor TP5.

Next, the operation of the semiconductor device shown in FIG. 3 will be described.

The reference voltage circuit 30 is a constant voltage circuit called band gap reference circuit. The differential amplifier DA2 performs negative feedback to an output from a current mirror circuit made from the diodes D1 and D2, resistor R1, and pMOS transistors TP2 and TP3 to maintain the constant reference voltage VREF within a voltage range even if the power supply voltage Vcc changes.

In the voltage dropping circuit 20, the reference voltage VREF from the reference voltage circuit 10 is applied to the positive input terminals of the differential amplifiers DA3 and DA4. The internal power supply voltage VINT is divided by the resistors R1 and R2 to generate a divided voltage VDI. The differential amplifiers DA3 and DA4 compare the divided voltage VDI with the reference voltage VREF, and this comparison result is amplified and supplied to the gate of the current supply transistor TP5. That is, the positive input and negative input terminals of the differential amplifier DA3 are respectively connected to those of the differential amplifier DA4 in parallel with the divided voltage VDI obtained by dividing the internal power supply voltage VINT by the resistors R3 and R4, and the reference voltage VREF. The steady current of the differential amplifier DA4 is larger than that of the differential amplifier DA3 to increase driving capability. As a result, the response of the feedback loop improves.

As shown in FIG. 2, at the leading edge of the external power supply voltage Vcc, e.g., at power-on, the leading edge of the power supply voltage Vcc is detected by using a known power-on detection circuit to output the power-on signal PO with a constant pulse width. This power-on signal PO is supplied to the control terminal of the differential amplifier DA4, and the gate of the nMOS transistor TN2 which are included in the negative feedback circuit. Hence, the differential amplifier DA4 operates only for a predetermined time to turn on the transistor TN2. Thus, the current flowing into the output terminal of the differential amplifier DA3 and the gate of the pMOS transistor TP1 increases to improve the response of the feedback loop. As described above, since the response of the feedback loop improves, the negative feedback circuit can be prevented from unstable operation at the leading edge of the external power supply voltage Vcc to maintain the constant internal power supply voltage VINT.

If the internal power supply voltage VINT is reduced, the divided voltage VDI is also reduced. Accordingly, the gate voltage of the current supply transistor, which is supplied from the differential amplifier DA3 is also reduced. Hence, the internal power supply voltage VINT is returned to a start voltage by supplying the current. As described above, the negative feedback is performed by using the divided voltage VDI of the internal power supply voltage VINT, the reference voltage VREF, the differential amplifier DA3, and the current supply transistor TP5 to maintain the constant internal power supply voltage VINT. Any type of differential amplifier is allowed in this operation. However, a current mirror differential amplifier is often used.

Note that, in this embodiment, when the general operating state is implemented at this leading edge of the external power supply voltage Vcc, the differential amplifier DA4 and the nMOS transistor TN2 are also turned off. Hence, the steady current of the negative feedback circuit decreases to reduce current consumption in the general operating state.

As described above, in this embodiment, the steady current of the negative feedback circuit increases only when turning on the power supply to apply the stable internal power supply voltage even when turning on the power supply. In the general operating state, i.e., except for when turning on the power supply, the steady current of the negative feedback circuit can decrease to reduce current consumption.

Third Embodiment

Next, a semiconductor device according to a third embodiment of the present invention will be described. This semiconductor device prevents a reference voltage circuit and a voltage dropping circuit from unstable operation when turning on an external power supply. The same reference numerals denote the same parts as in the first and second embodiments.

Figure 4:
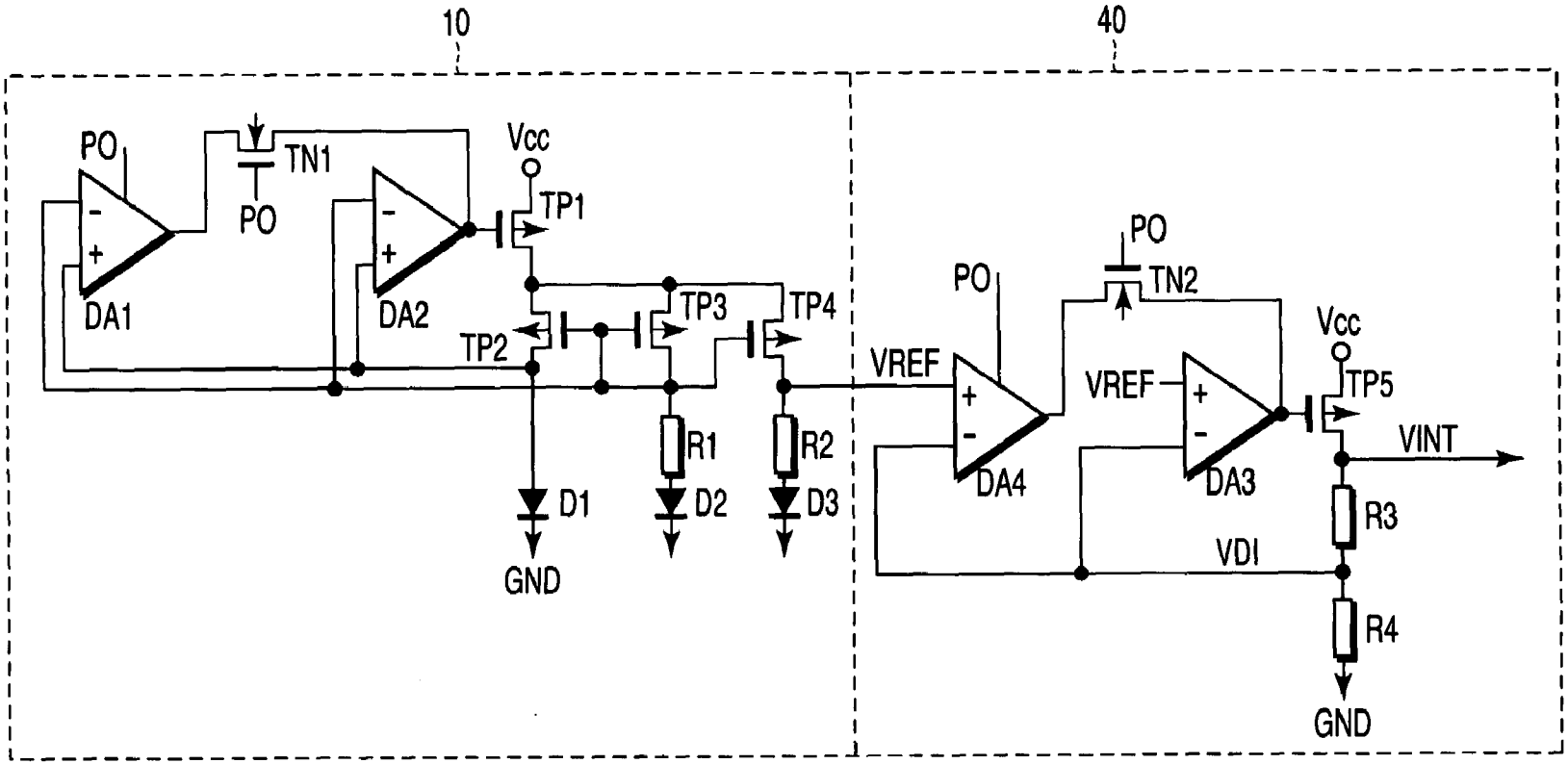
FIG. 4 is a circuit diagram showing the arrangement of a semiconductor device according to a third embodiment of the present invention.

FIG. 4 is a circuit diagram showing the arrangement of the semiconductor device according to the third embodiment.

This semiconductor device includes a reference voltage circuit 10 and a voltage dropping circuit 40. The arrangement and operation of each of the reference voltage circuit 10 and the voltage dropping circuit 40 are same as those of the reference voltage circuit 10 and the voltage dropping circuit 40 in the first and second embodiments.

In this embodiment, the steady current of the negative feedback circuit increases only at the leading edge of an external power supply voltage Vcc to apply a stable reference voltage VREF and internal power supply voltage VINT even at the leading edge of the power supply voltage Vcc. In the general operating state, i.e., except at the leading edge of the external power supply voltage Vcc, the steady current of the negative feedback circuit can decrease to reduce current consumption.

Fourth Embodiment

A semiconductor device according to a fourth embodiment of the present invention will be described below. Assume that a semiconductor memory operates in synchronism with an external signal output from an external unit. When a large power supply current flows because of the operation of the semiconductor memory, a negative feedback circuit may operate unstably in a reference voltage circuit or a voltage dropping circuit. In this semiconductor device, the current of the negative feedback circuit increases to prevent the reference voltage circuit and the voltage dropping circuit from unstable operation not only when turning on a power supply but also when operating in synchronism with the input signal from the external unit. In the fourth embodiment, the semiconductor device is applied to the third embodiment shown in FIG. 4. However, the semiconductor device can also be applied to the first or second embodiment. Note that the same reference numerals denote the same parts as in the third embodiment.

The semiconductor memory which operates in synchronism with a chip enable signal /CE will be described below. In this case, the semiconductor memory operates when the chip enable signal /CE is at low level, and stands by when the chip enable signal /CE is at high level. Hence, the steady current of the negative feedback circuit increases while the chip enable signal /CE is at low level to prevent the negative feedback circuit from an unstable operation. Alternatively, while the chip enable signal /CE is at high level, the steady current of the negative feedback circuit is reduced to reduce standby current.

Figure 5:
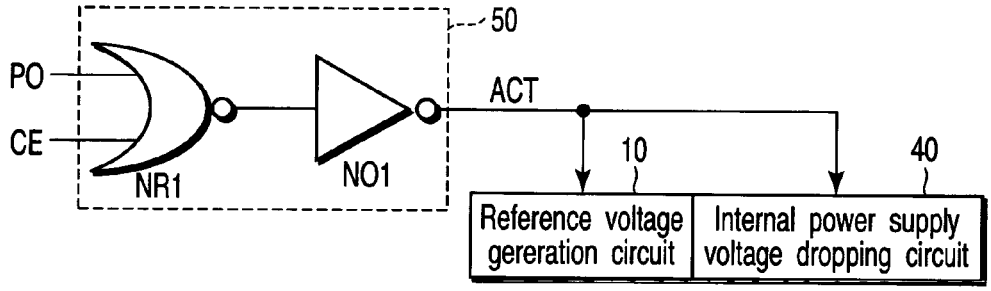
FIG. 5 is a circuit diagram showing the arrangement of a semiconductor device according to a fourth embodiment of the present invention.

FIG. 5 is a circuit diagram showing the arrangement of the semiconductor device according to the fourth embodiment. This semiconductor device includes a reference voltage circuit 10, a voltage dropping circuit 40, and an operation detection circuit 50. The operation detection circuit 50 includes a logical sum negative circuit (to be referred to as a NOR circuit hereinafter) NR1, and an inverter circuit (to be referred to as a NOT circuit hereinafter) NO1.

A power-on signal PO and a chip enable signal CE are respectively input to the first and second input terminals of the NOR circuit NR1. As described above, the power-on signal PO represents the leading edge of an external power supply voltage Vcc, and becomes high level signal with a constant pulse width at this leading edge. The chip enable signal CE represents the operating state or standby state of the semiconductor memory. When the semiconductor memory is in the operating state, the chip enable signal CE becomes a high level signal.

The output terminal of the NOR circuit NR1 is connected to the input terminal of the NOT circuit NO1 to output an active signal ACT from the output terminal of the NOR circuit NR1. In place of the power-on signal PO, this active signal ACT is supplied to the reference voltage circuit 10 and the voltage dropping circuit 40. That is, the active signal ACT is supplied to the control terminal of a differential amplifier DA1, and gate of an nMOS transistor TN1 in the reference voltage circuit 10. The active signal ACT is also supplied to the control terminal of a differential amplifier DA4, and gate of an nMOS transistor TN2 in the voltage dropping circuit 40.

Figure 6:
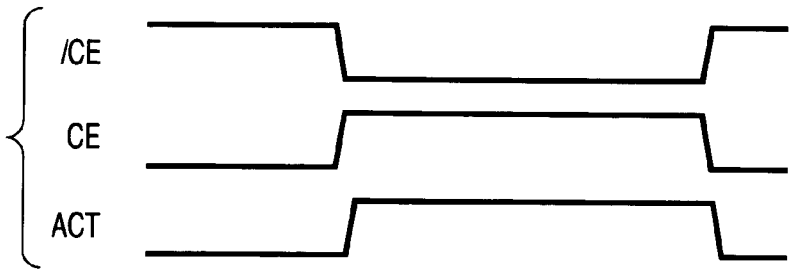
FIG. 6 is a timing chart of chip enable signals and an active signal according to the fourth embodiment.

FIG. 6 shows a timing chart of the chip enable signals /CE and CE, and active signal ACT in the semiconductor device shown in FIG. 5. When the chip enable signal CE goes high level, the active signal ACT also goes high level. In place of the power-on signal PO shown in FIG. 4, this active signal ACT (high level) is supplied to the control terminals of the differential amplifiers DA1 and DA4, and the transistors TN1 and TN2, which are included in the negative feedback circuit. Hence, the differential amplifiers DA1 and DA4 operate only for a predetermined time, the transistors TN1 and TN2 are turned on, and the steady current of the negative feedback circuit increases, such that the response of the feedback loop improves. According to this operation, when the large current flows in operating the semiconductor memory, the negative feedback circuit can be prevented from unstable operation to maintain a constant reference voltage VREF and an internal power supply voltage VINT.

Also, when the power-on signal PO goes high level at the leading edge of the external power supply voltage Vcc, the active signal ACT also goes high level. Therefore, in place of the power-on signal PO shown in FIG. 4, this active signal ACT (high level) is supplied to the differential amplifiers DA1 and DA4, and the transistors TN1 and TN2. Hence, the differential amplifiers DA1 and DA4 operate only for a predetermined time, the transistors TN1 and TN2 are turned on, and the steady current of the negative feedback circuit increases, such that the response of the feedback loop improves. According to this operation, at the leading edge of the external power supply voltage Vcc, the negative feedback circuit can be prevented from an unstable operation to maintain the constant reference voltage VREF and the internal power supply voltage VINT.

As described above, the active signal ACT obtained by the logical sum of the chip enable signal CE and the power-on signal PO is used as a signal to increase the steady current of the negative feedback circuit. Hence, the negative feedback circuit can be prevented from unstable operation even in operating the semiconductor memory or at the leading edge of the external power supply voltage. As a result, the reference voltage and the internal power supply voltage can be applied stably.

Fifth Embodiment

A semiconductor device according to a fifth embodiment of the present invention will be described below. In the fourth embodiment, a countermeasure for the semiconductor memory which operates in synchronism with the input signal from the external unit is described. However, in the fifth embodiment, a countermeasure for a semiconductor memory which is an asynchronous memory operating in synchronism with address switching will be described. When a large power supply current flows because of the address switching in the semiconductor memory, a negative feedback circuit may unstably operate in a reference voltage circuit or a voltage dropping circuit. In this semiconductor device, the current of the negative feedback circuit increases to prevent the reference voltage circuit and the voltage dropping circuit from unstable operations not only when turning on a power supply but also when operating in synchronism with the input of an address signal. In the fifth embodiment, the semiconductor device is applied to the third embodiment shown in FIG. 4. However, the semiconductor device can also be applied to the first or second embodiment. Note that the same reference numerals denote the same parts as in the third embodiment.

The semiconductor memory which operates in synchronism with the address switching will be described below. In this case, since the current decreases after a predetermined time from the address switching, an address transition detector circuit which detects the address switching generates a switching signal ATD which becomes high level for a predetermined time after the address switching. Then, the steady current of the negative feedback circuit increases while the switching signal ATD is set at high level to prevent the negative feedback circuit from unstable operation. Alternatively, while the switching signal ATD is set at low level, the steady current of the negative feedback circuit is reduced to reduce standby current.

Figure 7:
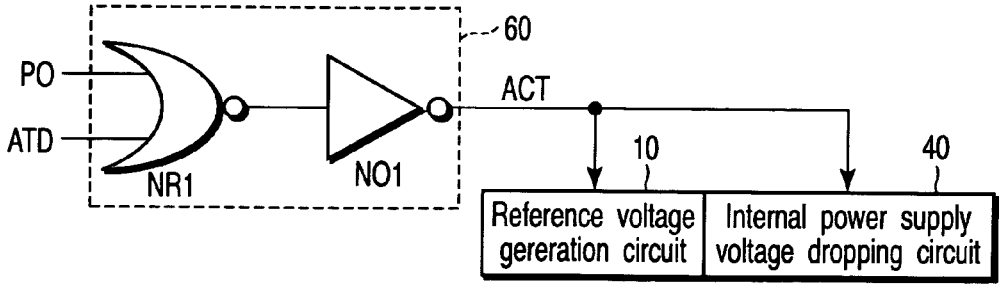
FIG. 7 is a circuit diagram showing the arrangement of a semiconductor device according to a fifth embodiment of the present invention.

FIG. 7 is a circuit diagram showing the arrangement of the semiconductor device according to the fifth embodiment. This semiconductor device includes a reference voltage circuit 10, a voltage dropping circuit 40, and an operation detection circuit 60. The operation detection circuit 60 includes a NOR circuit NR1, and a NOT circuit NO.

A power-on signal PO and the switching signal ATD are respectively input to the first and second input terminals of the NOR circuit NR1. The output terminal of the NOR circuit NR1 is connected to the input terminal of the NOT circuit NO1 to output an active signal ACT from the output terminal of the NOR circuit NR1. In place of the power-on signal PO, this active signal ACT is supplied to the reference voltage circuit 10 and the voltage dropping circuit 40. That is, the active signal ACT is supplied to the control terminal of a differential amplifier DA1, and gate of an nMOS transistor TN1 in the reference voltage circuit 10. The active signal ACT is also supplied to the control terminal of a differential amplifier DA4, and gate of an nMOS transistor TN2 in the voltage dropping circuit 40.

Figure 8:
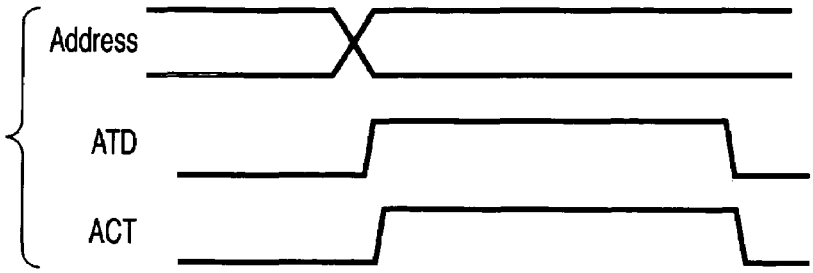
FIG. 8 is a timing chart of an address input, a switching signal, and an active signal according to the fifth embodiment.

FIG. 8 shows a timing chart of the address signal input, switching signal ATD, and active signal ACT in the semiconductor device shown in FIG. 7. When the switching signal ATD goes high level, the active signal ACT also goes high level. In place of the power-on signal PO shown in FIG. 4, this active signal ACT (high level) is supplied to the control terminals of the differential amplifiers DA1 and DA4, and the transistors TN1 and TN2, which are included in the negative feedback circuit. Hence, the differential amplifiers DA1 and DA4 operate only for a predetermined time, the transistors TN1 and TN2 are turned on, and the steady current of the negative feedback circuit increases, such that the response of the feedback loop improves. According to this operation, in an asynchronous memory which operates in synchronism with the address switching, even when the large current flows in operating the semiconductor memory, the negative feedback circuit can be prevented from unstable operation to maintain a constant reference voltage VREF and an internal power supply voltage VINT.

Also, when the power-on signal PO goes high level at the leading edge of an external power supply voltage Vcc, the active signal ACT also goes high level. Therefore, in place of the power-on signal PO shown in FIG. 4, this active signal ACT (high level) is supplied to the differential amplifiers DA1 and DA4, and the transistors TN1 and TN2. Hence, the differential amplifiers DA1 and DA4 operate only for a predetermined time, the transistors TN1 and TN2 are turned on, and the steady current of the negative feedback circuit increases, such that the response of the feedback loop improves. According to this operation, at the leading edge of the external power supply voltage Vcc, the negative feedback circuit can be prevented from unstable operation to maintain the constant reference voltage VREF and the internal power supply voltage VINT.

As described above, the active signal ACT obtained by the logical sum of the switching signal ATD and the power-on signal PO is used as a signal to increase the steady current of the negative feedback circuit. Hence, the negative feedback circuit can be prevented from unstable operation even in the operation in synchronism with the address switching or at the leading edge of the external power supply voltage. As a result, the reference voltage and the internal power supply voltage can be applied stably.

Sixth Embodiment

Next, a semiconductor device according to a sixth embodiment of the present invention will be described below. Assume that a semiconductor memory operates in synchronism with a chip enable signal /CE as described in the fourth embodiment. A bit line is precharged at the leading edge of the chip enable signal /CE. When a large power supply current flows in precharging, a negative feedback circuit may unstably operate in a reference voltage circuit or a voltage dropping circuit. In this semiconductor device, the current of the negative feedback circuit increases to prevent the reference voltage circuit and the voltage dropping circuit from unstable operation not only when turning on a power supply but also when precharging the bit line. In the sixth embodiment, the semiconductor device is applied to the third embodiment shown in FIG. 4. However, the semiconductor device can also be applied to the first or second embodiment. Note that the same reference numerals denote the same parts as in the third embodiment.

The large power supply current which flows in the bit line precharge operation will be described below. In this case, a bit line precharge signal BLPC generated at a start of the precharge operation in the semiconductor memory is used. At the leading edge of the chip enable signal /CE, the bit line precharge signal BLPC becomes an high level signal with a constant pulse width, i.e., generates a pulse. Hence, the steady current of the negative feedback circuit increases while the bit line precharge signal BLPC is set at high level to prevent the negative feedback circuit from an unstable operation. Alternatively, while the bit line precharge signal BLPC is set at low level, the steady current of the negative feedback circuit is reduced to reduce standby current.

Figure 9:
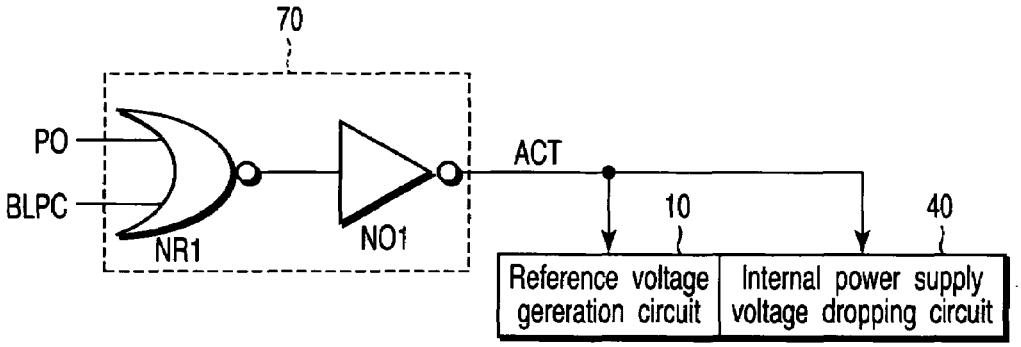
FIG. 9 is a circuit diagram showing the arrangement of a semiconductor device according to a sixth embodiment of the present invention.

FIG. 9 is a circuit diagram showing the arrangement of the semiconductor device according to the sixth embodiment. This semiconductor device includes a reference voltage circuit 10, a voltage dropping circuit 40, and an operation detection circuit 70. The operation detection circuit 70 includes a NOR circuit NR1, and a NOT circuit NO1.

A power-on signal PO and the bit line precharge signal BLPC are respectively input to the first and second input terminals of the NOR circuit NR1. The output terminal of the NOR circuit NR1 is connected to the input terminal of the NOT circuit NO1 to output an active signal ACT from the output terminal of the NOR circuit NR1. In place of the power-on signal PO, this active signal ACT is supplied to the reference voltage circuit 10 and the voltage dropping circuit 40. That is, the active signal ACT is supplied to the control terminal of a differential amplifier DA1, and gate of an nMOS transistor TN1 in the reference voltage circuit 10. The active signal ACT is also supplied to the control terminal of a differential amplifier DA4, and gate of an nMOS transistor TN2 in the voltage dropping circuit 40.

Figure 10:
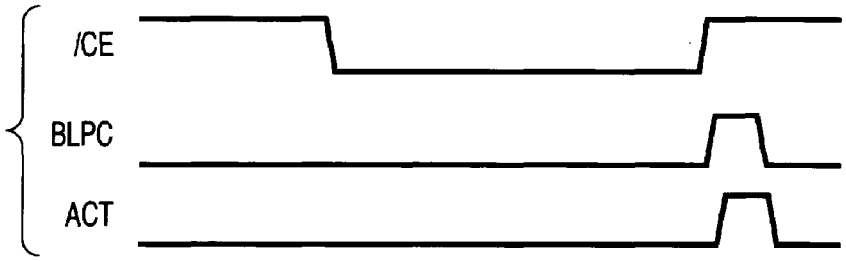
FIG. 10 is a timing chart of a chip enable signal, a bit line precharge signal, and an active signal according to the sixth embodiment.

FIG. 10 shows a timing chart of the chip enable signal /CE, bit line precharge signal BLPC, and active signal ACT in the semiconductor device shown in FIG. 9. When the chip enable signal /CE goes high level, the bit line is precharged, and the bit line precharge signal BLPC goes high level. When the bit line precharge signal BLPC goes high level, the active signal ACT also goes high level. In place of the power-on signal PO shown in FIG. 4, this active signal ACT (high level) is supplied to the control terminals of the differential amplifiers DA1 and DA4, and the transistors TN1 and TN2, which are included in the negative feedback circuit. Hence, the differential amplifiers DA1 and DA4 operate only for a predetermined time, the transistors TN1 and TN2 are turned on, and the steady current of the negative feedback circuit increases, such that the response of the feedback loop improves. According to this operation, when the large power supply current flows in the bit line precharge operation, the negative feedback circuit can be prevented from unstable operation to maintain a constant reference voltage VREF and an internal power supply voltage VINT.

Also, when the power-on signal PO goes high level at the leading edge of an external power supply voltage Vcc, the active signal ACT also goes high level. Therefore, in place of the power-on signal PO shown in FIG. 4, this active signal ACT (high level) is supplied to the differential amplifiers DA1 and DA4, and the transistors TN1 and TN2. Hence, the differential amplifiers DA1 and DA4 operate only for a predetermined time, the transistors TN1 and TN2 are turned on, and the steady current of the negative feedback circuit increases, such that the response of the feedback loop improves. According to this operation, at the leading edge of the external power supply voltage Vcc, the negative feedback circuit can be prevented from unstable operation to maintain the constant reference voltage VREF and the internal power supply voltage VINT.

As described above, the signal ACT obtained by the logical sum of the bit line precharge signal BLPC and the signal PO is used as a signal to increase the steady current of the negative feedback circuit. Hence, the negative feedback circuit can be prevented from unstable operation even in the bit line precharge operation or at the leading edge of the external power supply voltage. As a result, the reference voltage and the internal power supply voltage can be applied stably.

Figure 11:
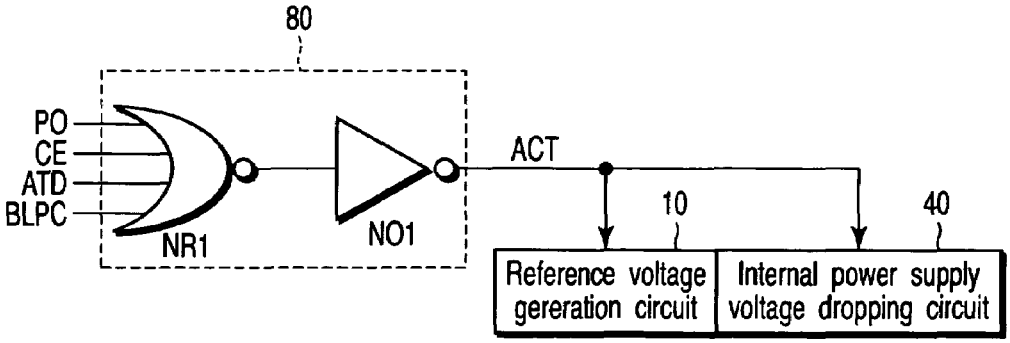
FIG. 11 is a circuit diagram showing the arrangement of a modification of a semiconductor device according to the sixth embodiment.

As shown in FIG. 11, the power-on signal PO, chip enable signal CE, switching signal ATD, and bit line precharge signal BLPC can be input to the first, second, third, and fourth input terminals of the NOR circuit NR1 in an operation detection circuit 80, respectively.

In this arrangement, at the leading edge of the external power supply voltage Vcc, even when the semiconductor device operates in synchronism with the input signal from the external unit, operates in synchronism with the address switching, or precharges the bit line, the negative feedback circuit can be prevented from unstable operation to apply the reference voltage and the internal power supply voltage, stably.

In the embodiments of the present invention, the internal power supply voltage dropping circuit can be provided, which can apply the stable internal power supply voltage even when turning on the power supply or operating the internal circuit, without increasing the current consumption.

The above-described embodiments are not only implemented alone, but also may be properly combined as much as possible. Furthermore, the embodiments include the inventions of various stages, and the inventions of various stages can be extracted by proper combinations of a plurality of disclosed building components in the embodiments.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A semiconductor device comprising:

a reference voltage generation circuit which includes a negative feedback circuit, and generates a reference voltage controlled by an output signal from the negative feedback circuit;

an amplifier circuit which amplifies the output signal from the negative feedback circuit during at least one of a leading edge of an external power supply voltage and input time of an external signal; and a voltage dropping circuit which drops the external power supply voltage in accordance with the reference voltage output from the reference voltage generation circuit to generate an internal power supply voltage, wherein the reference voltage generation circuit includes a current mirror circuit, and the negative feedback circuit includes a first differential amplifier circuit where an output from the current mirror circuit is supplied to an input terminal, wherein the amplifier circuit includes a second differential amplifier circuit whose input terminal is connected to the input terminal of the first differential amplifier circuit in parallel, and the second differential amplifier circuit operates only for a predetermined time during at least one of the leading edge of the external power supply voltage and the input time of the external signal, and does not operate after the predetermined time, and wherein an output from the second differential amplifier circuit is supplied to an output from the first differential amplifier circuit via a MOS transistor.

2. The semiconductor device according to claim 1, wherein the external signal comprises at least one of a signal for instructing a start of an operation of an internal circuit in the semiconductor device, a signal for representing address switching of a memory cell, and a signal for representing a start of a bit line precharge operation.

3. A semiconductor device comprising:

a reference voltage generation circuit which generates a reference voltage;

a voltage dropping circuit which includes a negative feedback circuit for outputting an output signal in accordance with the reference voltage output from the reference voltage generation circuit, and a divided voltage of an internal power supply voltage obtained by dropping an external power supply voltage, and generates the internal power supply voltage controlled by the output signal from the negative feedback circuit; and an amplifier circuit which amplifies the output signal from the negative feedback circuit during at least one of a leading edge of an external power supply voltage and input time of an external signal, wherein the negative feedback circuit includes a first differential amplifier circuit having a first input terminal and a second input terminal, the reference voltage is applied to the first input terminal, and the divided voltage is applied to the second input terminal, and wherein the amplifier circuit includes a second differential amplifier circuit having a third input terminal and a fourth input terminal, the reference voltage is applied to the third input terminal, and the divided voltage is applied to the fourth input terminal.

4. The semiconductor device according to claim 3, wherein an output from the second differential amplifier circuit is supplied to an output from the first differential amplifier circuit via a MOS transistor.

5. The semiconductor device according to claim 3, wherein the external signal comprises at least one of a signal for instructing a start of an operation of an internal circuit in the semiconductor device, a signal for representing address switching of a memory cell, and a signal for representing a start of a bit line precharge operation.

6. A semiconductor device comprising:

a reference voltage generation circuit which includes a first negative feedback circuit, and generates a reference voltage controlled by an output signal from the first negative feedback circuit;

a first amplifier circuit which amplifies the output signal from the first negative feedback circuit during at least one of a leading edge of an external power supply voltage and input time of an external signal;

a voltage dropping circuit which includes a second negative feedback circuit for outputting an output signal in accordance with the reference voltage output from the reference voltage generation circuit, and a divided voltage of an internal power supply voltage obtained by dropping the external power supply voltage, and generates the internal power supply voltage controlled by the output signal from the second negative feedback circuit; and a second amplifier circuit which amplifies the output signal from the second negative feedback circuit during at least one of the leading edge of the external power supply voltage and the input time of the external signal.

7. The semiconductor device according to claim 6, wherein the reference voltage generation circuit includes a current mirror circuit, and the first negative feedback circuit includes a first differential amplifier circuit where an output from the current mirror circuit is supplied to an input terminal.

8. The semiconductor device according to claim 7, wherein the first amplifier circuit includes a second differential amplifier circuit whose input terminal is connected to the input terminal of the first differential amplifier circuit in parallel, and the second differential amplifier circuit operates only for a predetermined time during at least one of the leading edge of the external power supply voltage and the input time of the external signal, and does not operate after the predetermined time.

9. The semiconductor device according to claim 8, wherein an output from the second differential amplifier circuit is supplied to an output from the first differential amplifier circuit via a MOS transistor.

10. The semiconductor device according to claim 6, wherein the second negative feedback circuit includes a third differential amplifier circuit having a first input terminal and a second input terminal, the reference voltage is applied to the first input terminal, and the divided voltage is applied to the second input terminal.

11. The semiconductor device according to claim 10, wherein the second amplifier circuit includes a fourth differential amplifier circuit having a third input terminal and a fourth input terminal, the reference voltage is applied to the third input terminal, and the divided voltage is applied to the fourth input terminal.

12. The semiconductor device according to claim 11, wherein an output from the fourth differential amplifier circuit is supplied to an output from the third differential amplifier circuit via a MOS transistor.

13. The semiconductor device according to claim 6, wherein the external signal comprises at least one of a signal for instructing a start of an operation of an internal circuit in the semiconductor device, a signal for representing address switching of a memory cell, and a signal for representing a start of a bit line precharge operation.

* * * * *